US009248454B2

(12) United States Patent
Colladon

(10) Patent No.: US 9,248,454 B2
(45) Date of Patent: Feb. 2, 2016

(54) DEVICE AND METHOD FOR RECOVERING MAGNETIC PARTICLES TRAPPED ON A MAGNETIC PLUG

(75) Inventor: Fabrice Colladon, Dammarie-lès-Lys (FR)

(73) Assignee: SNECMA, Paris (FR)

( * ) Notice: Subject to any disclaimer, the term of this patent is extended or adjusted under 35 U.S.C. 154(b) by 743 days.

(21) Appl. No.: 13/504,277

(22) PCT Filed: Oct. 22, 2010

(86) PCT No.: PCT/EP2010/066000

§ 371 (c)(1),
(2), (4) Date: Apr. 26, 2012

(87) PCT Pub. No.: WO2011/051192

PCT Pub. Date: May 5, 2011

(65) Prior Publication Data

US 2012/0204910 A1 Aug. 16, 2012

(30) Foreign Application Priority Data

Oct. 30, 2009 (FR) ..... 09 57682

(51) Int. Cl.
*B08B 5/00* (2006.01)
*B03C 1/28* (2006.01)
*B03C 1/032* (2006.01)

(52) U.S. Cl.
CPC ..... *B03C 1/284* (2013.01); *B03C 1/032* (2013.01); *B03C 1/286* (2013.01)

(58) Field of Classification Search
CPC ..... B03C 1/284; B03C 1/286; B03C 1/032
USPC ..... 134/37, 104.3; 15/405
See application file for complete search history.

(56) References Cited

U.S. PATENT DOCUMENTS

| | | | | |
|---|---|---|---|---|
| 4,266,982 | A | 5/1981 | Bender et al. | |
| 2001/0022948 | A1 | 9/2001 | Tuunanen | |
| 2006/0283783 | A1 * | 12/2006 | Adey | 209/39 |
| 2008/0233041 | A1 * | 9/2008 | Jang | B03C 1/286 423/445 B |

FOREIGN PATENT DOCUMENTS

| | | | | |
|---|---|---|---|---|
| EP | 1 445 024 | A1 | 8/2004 | |
| EP | 1445024 | A1 * | 8/2004 | B03C 1/284 |
| WO | WO 87/05536 | | 9/1987 | |
| WO | WO 2009111769 | A2 * | 9/2009 | B01F 13/002 |

OTHER PUBLICATIONS

International Search Report as issued for PCT/EP2010/066000.

* cited by examiner

*Primary Examiner* — Michael Kornakov
*Assistant Examiner* — Katelyn Whatley
(74) *Attorney, Agent, or Firm* — Pillsbury Winthrop Shaw Pittman LLP

(57) ABSTRACT

A device for recovering magnetic particles trapped on a magnetic plug, which includes a supporting end and a magnetized element for retaining the magnetic particles in a liquid resulting from the wear of parts with which the liquid has been in contact, the recovery device including a magnetization device and an enclosure having an opening, the enclosure to receive the magnetic plug via the opening such that the magnetized element is located inside the enclosure and the supporting end is located outside the enclosure. The opening is sized such that the supporting end blocks the opening. The device also includes an injection nozzle to inject a gaseous fluid inside the enclosure, the nozzle being oriented such that the flow of gaseous fluid expels the magnetic particles retained on the magnetized element toward the bottom of the enclosure. The magnetization device traps the particles urged toward the bottom of the enclosure.

18 Claims, 3 Drawing Sheets

DEVICE AND METHOD FOR RECOVERING MAGNETIC PARTICLES TRAPPED ON A MAGNETIC PLUG

CROSS REFERENCE TO RELATED APPLICATIONS

This application is the U.S. National Stage of PCT/EP2010/066000, filed Oct. 22, 2010, which in turn claims priority to French Patent Application No. 0957682, filed Oct. 30, 2009, the entire contents of all applications are incorporated herein by reference in their entireties.

FIELD

The invention relates to a device and method for recovering magnetic particles trapped on a magnetic plug intended to retain, by means of a magnet, the magnetic particles in a liquid resulting from the wear of parts, such as for example rotating parts disposed in an equipment case or aircraft engine.

BACKGROUND

In a known manner, a magnetic plug is placed in a liquid circuit (typically oil, liquid coolant or fuel) inside a case containing the moving parts, such as gear wheels or bearings, that stand in said liquid.

In general, the function of the liquid circuit is to enable the lubrication and/or cooling of moving parts (typically rotating parts). It turns out that the moving parts are caused to wear away throughout their lives, for example due to the friction resulting from the contact between two toothed wheels or bearings, or rather due to the shocks or intense friction between rotating parts due to intense and abnormal vibrations propagating through the case. Whatever the cause, the wear of parts leads to the formation of particles that detach from the parts and are driven by the liquid in the liquid circuit. Insofar as the rotating parts are generally metallic, the particles resulting from the wear of parts are conductive and are generally present in the form of filings. Furthermore, the parts are most often made from a ferromagnetic type metal such as iron, i.e., a metal that is capable of being attracted by a magnetic element such as a magnet.

In a known manner, such as schematically illustrated in FIG. 1, a magnetic plug 1 comprises at one end a head or support 2 and a permanent magnet formed by a magnetic bar 3 immersed in a liquid circuit, said magnetic bar 3 attracting metallic particles 4 when the liquid circulates. The operators on site must then periodically verify the condition of these magnetic plugs, remove the particles trapped on the magnetic bar and analyze these particles, for example by analyses of the SEM Scanning Electron Microscopy and EDS Energy Dispersive Spectroscopy type. From these analyses, it is possible to identify the nature and geometry of the removed particles; depending on the removal site of the plug, one may then limit the element or elements affected by wear and take measures that will guarantee the integrity of the machine and safety of the flight. It will be noted that the magnetic plugs are most often coupled with filters, the latter used to trap non-ferromagnetic particles.

Different techniques are known that enable the operators to remove particles trapped on the magnetic plug.

A first technique consists of using adhesive tape that the operator puts in contact with the magnetic bar of the plug. Such a solution is not entirely satisfactory insofar as the particles remain stuck on the adhesive and are difficult to extract (by dissolution) for analysis. Therefore it remains a residue of particles that cannot be used in the analysis and leads to a loss of data. In addition, the adhesive may generate surface pollution of the particles that is likely to distort the material analysis results.

A second technique consists of using a cloth to remove the particles on the magnetic bar.

Such a solution also poses certain difficulties. In fact, it, is necessary to clean the cloth, by immersing it in a solvent and then filtering the product obtained to recover the particles. In addition, the use of a cloth makes the recovery of all particles difficult; consequently, all of the particles are not available to carry out the analysis and a particle residue remains present on the magnetic bar, this residue being likely to distort the indication of pollution during a subsequent control. Lastly, the use of a potentially polluted cloth may lead to a suspicion of parasite pollution.

A third technique may consist of directly removing the particles on the bar by using a magnet that is more powerful than the magnet of the magnetic bar.

However, such a solution is difficult to utilize since it would lead to a risk of altering the magnetic plug by modifying the remnant field of the latter.

SUMMARY

More particularly, the goal of the invention is to remedy the aforementioned disadvantages. In this context, the present invention aims to provide a device enabling the rapid, reliable and complete recovery of magnetic particles trapped on a magnetic plug.

For this purpose, the invention applies to a device for recovering magnetic particles trapped on a magnetic plug, said magnetic plug comprising a supporting end and a magnetized element intended to retain the magnetic particles driven by a liquid resulting from the wear of parts with which said liquid has been in contact, said recovery device comprising:

- magnetization means;
- an enclosure integrating:
  - an opening, said enclosure being capable of receiving said magnetic plug via said opening such that said magnetized element is housed inside said enclosure and said supporting end is situated outside said enclosure, said opening being sized so that said supporting end blocks said opening;
  - at least one injection nozzle capable of injecting a gaseous fluid inside said enclosure, said nozzle being oriented such that the flow of gaseous liquid expels the magnetic particles retained on the magnetized element toward the bottom of said enclosure, said magnetization means being arranged so as to trap, by means of magnetization, said particles urged toward the bottom of said enclosure.

Thanks to the invention, an injection of pressurized gas (preferentially filtered and de-oiled compressed air, injected for example at 6 bar) is utilized via at least one nozzle. The flow of gas will enable the magnetic particles found on the magnetic plug to be detached and will enable these particles to be sent to the bottom of the device enclosure. The presence of magnetization means preferentially arranged near the bottom and outside of the enclosure will enable these particles to be trapped (i.e., the particles may not rise again since they are trapped by the magnetization means). Therefore the device according to the invention is a tool for operators enabling all magnetic particles to be reliably recovered, these magnetic particles being disconnected from the magnetic plug under the effect of a jet of air when the plug is placed in the tool enclosure.

In addition to the principal characteristics that have just been mentioned in the previous paragraph, the device according to the invention may present one or more of the additional characteristics below, considered individually or according to all technically feasible combinations:

- the device according to the invention comprises a plurality of injection nozzles assembled on said enclosure;
- said magnetized element of said magnetic plug is a magnetic bar; said enclosure is sized to receive said magnetic bar inside said enclosure and said nozzles are disposed laterally on said enclosure so that they are situated on both sides of said bar when the latter is in position inside said enclosure;
- each of said nozzles is tilted 45° with relation to the axis of the bar when the latter is in position inside said enclosure;
- said magnetization means are disposed outside said enclosure near the bottom of said enclosure;
- said magnetization means are removably assembled on the outer face of the bottom of said enclosure;
- said magnetization means are arranged so as to be situated at a distance of between 2 and 5 cm from said magnetized element when the latter is inside said enclosure;
- the device according to the invention comprises sealing means such as an O-ring capable of ensuring sealing between said supporting end and said opening when said supporting end blocks said opening.

Another object of the invention is a method for recovering magnetic particles trapped on a magnetic plug by using a device according to the invention, said method comprising the following steps:

- placing the magnetic plug in the recovery device via the enclosure opening such that the magnetized element of the plug retaining the magnetic particles is housed inside the enclosure and the supporting end of the plug is situated outside the enclosure so as to block the enclosure opening;
- injecting compressed air, preferentially filtered via the injection nozzle or nozzles so that the particles retained on the magnetic element are evacuated toward the bottom of the enclosure;
- trapping the evacuated particles toward the bottom of the enclosure by said magnetization means;
- recovering the particles trapped by said magnetization means.

Advantageously, the step of recovering the particles comprises the following steps:

- removal of the magnetic plug and magnetization means removably assembled under the bottom of the enclosure;
- recovery of the particles by using a magnetized bar assembled slidingly in a tube.

BRIEF DESCRIPTION OF THE DRAWINGS

Other characteristics and advantages of the invention will clearly emerge from the description given below, for indicative and in no way limiting purposes, with reference to the attached figures, among which.

DETAILED DESCRIPTION

For reasons of clarity, only the elements useful for understanding the invention have been represented, without respecting the scale and schematic manner. In addition, similar elements found on different figures bear identical references.

Figure 1:
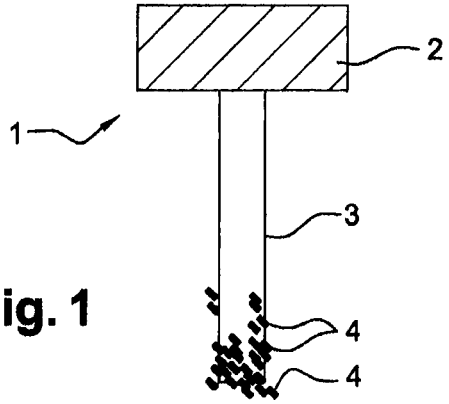
FIG. 1 schematically represents a magnetic plug.

FIG. 1 has already been described with reference to the prior art.

Figure 2:
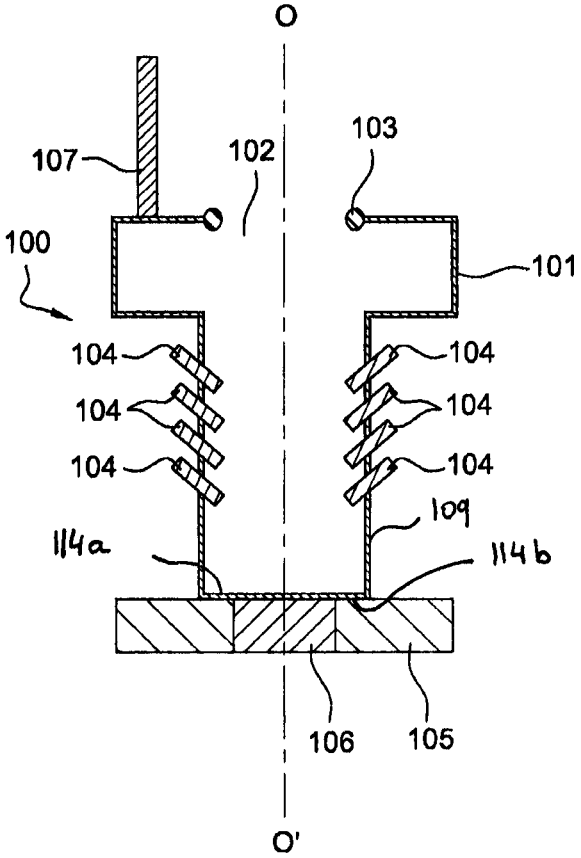
FIG. 2 schematically represents a device for recovering particles according to the invention.

FIG. 2 schematically represents a device 100 for recovering magnetic particles according to the invention. The device 100 according to the invention comprises:

- a T-shaped enclosure 101 with an opening 102 on its upper part and a substantially cylindrical receptacle 108 of vertical axis OO';
- sealing means 103 in the form of an O-ring disposed around the opening 102;
- a plurality of injection nozzles 104 traversing the lateral parts of the enclosure 101;
- a support 105 arranged in contact with the outer surface of the bottom of enclosure 101;
- a cylindrical magnet 106 removably assembled in support 105;
- a vent pipe 107.

Each of the nozzles 104 is tilted by an angle of 45° with relation to the vertical axis OO'.

Enclosure 101 may be made of a transparent plastic material.

We will describe, with reference to FIGS. 3 to 7, an example of a method for recovering ferromagnetic particles trapped on a magnetic plug 1 such as that represented in FIG. 1 by using the recovery device 100 according to the invention such as represented in FIG. 2. FIG. 8 represents the sequence of steps 201 to 205 of method 200. It will be noted that these steps 201 to 205 will preferentially be implemented on site by an operator.

Figure 3:
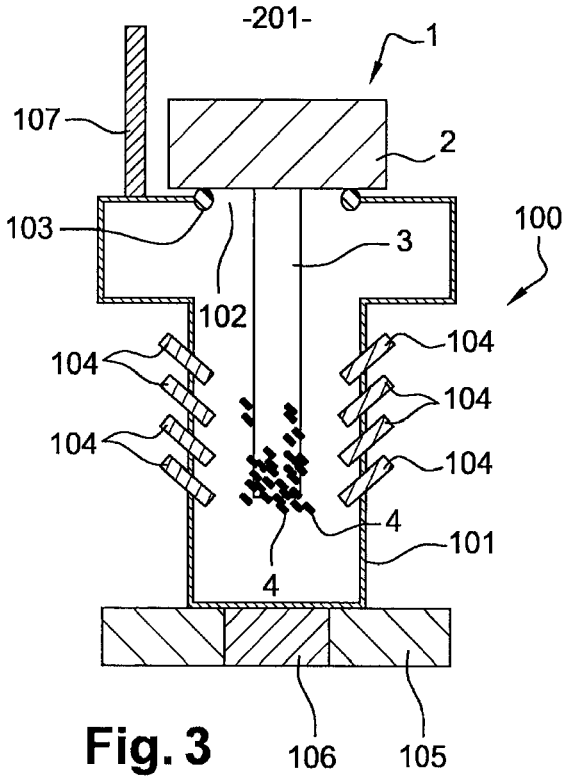
FIGS. 3 to 7 illustrate the different steps of a method for recovering particles according to the invention.

According to the first step 201 illustrated in FIG. 3, the magnetic plug 1, after having been recovered by the operator for analyzing the trapped particles 4, is placed in device 100. More precisely, the magnetic bar 3 (on which the magnetic particles 4 are retained) is inserted in enclosure 101 and the supporting end 2 (or head) of the plug 1 blocks opening 102. Opening 102 of device 1 thus must be sized so that its diameter is less than the diameter of the head 2 of plug 1.

The O-ring 103 ensures the sealing between the supporting end 2 and the opening 102.

Figure 4:
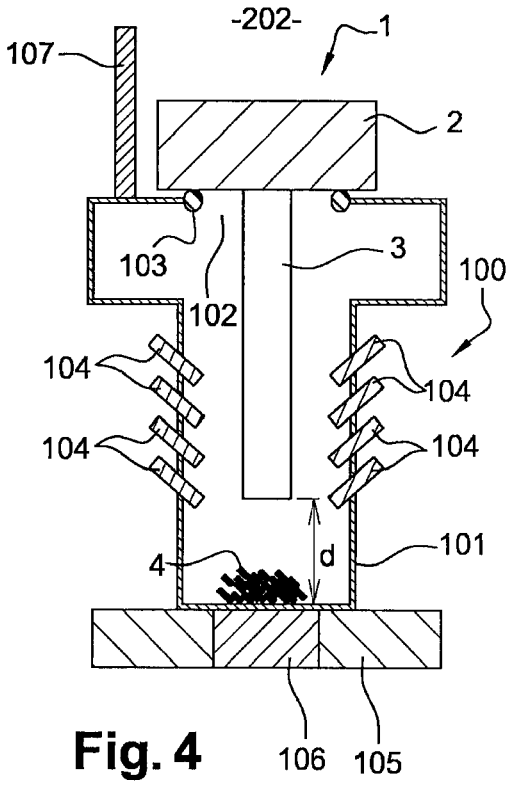

According to the second step 202 illustrated in FIG. 4, filtered and de-oiled (to prevent any pollution of particles 4) compressed air is injected for some seconds via nozzles 104 inside enclosure 101. The 45° tilt with relation to the vertical axis of nozzles 104 enables the jet of compressed air to be directed toward the end of the magnetic bar 3 on which the particles 4 are retained. All of the particles 4 found on bar 3 are consequently urged toward the bottom of the enclosure 101 and are trapped by magnet 106 that is sufficiently powerful to retain them at the bottom of the enclosure 101 and prevent them from rising back up toward the top of the enclosure.

Insofar as an injection of compressed air is carried out within the enclosure 101, a vent outlet is ensured by vent pipe 107 to prevent excess pressure.

Preferably, a magnet 106 presenting a magnetization (typically between 50 and 100 A/m) that is more powerful than that of the permanent magnet of the plug (generally between 25 and 30 A/m) will be chosen. In addition, the height of the enclosure 101 is adjusted so that the distance d separating the magnet 106 from the end of the magnetic bar 3 is between 2 and 5 cm: This distance d is sufficient so that the magnetization of the magnet 106 does not disrupt the magnetization of bar 3 that must remain substantially constant for a subsequent use.

Figure 5:
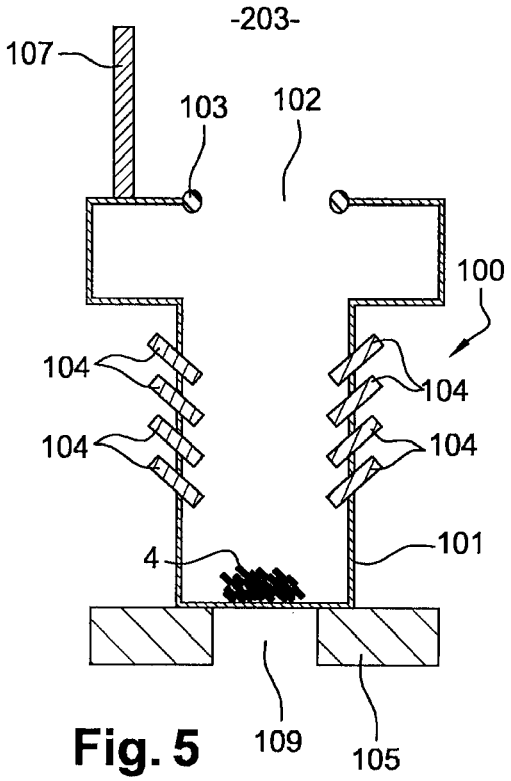

According to step 203 illustrated in FIG. 5, the magnetic plug 1 is extracted from device 100 according to the invention and then the magnet 106 is removed from support 105 (it is recalled that magnet 106 is assembled removably on support 105), the particles 4 are still located at the bottom of enclosure 101.

Figure 6:
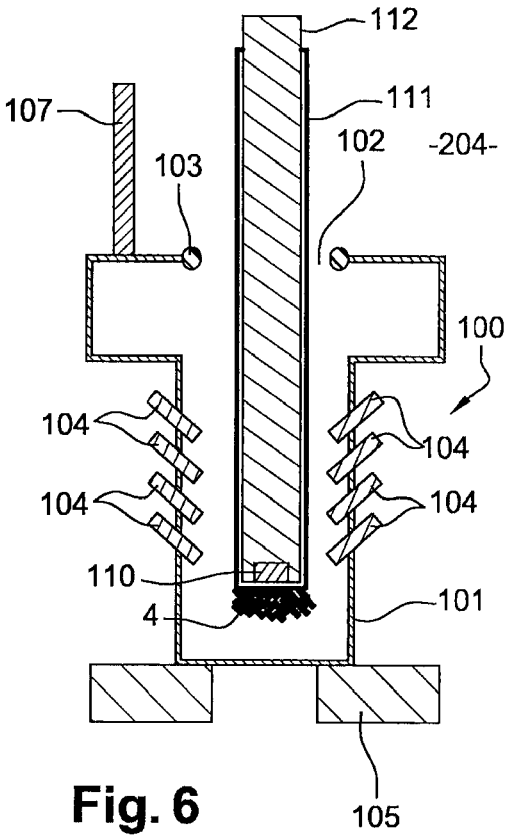

Step 204 illustrated in FIG. 6 will consist of recovering the particles 4 at the bottom of receptacle 101. To do this, a copper cylinder 112, for example, sliding in a glass tube 111 with a magnet 110 at its lower end, is used.

By immersing the cylinder 112 inserted in tube 111 to the bottom of enclosure 101, the particles 4 are magnetized by magnet 110.

Figure 7:
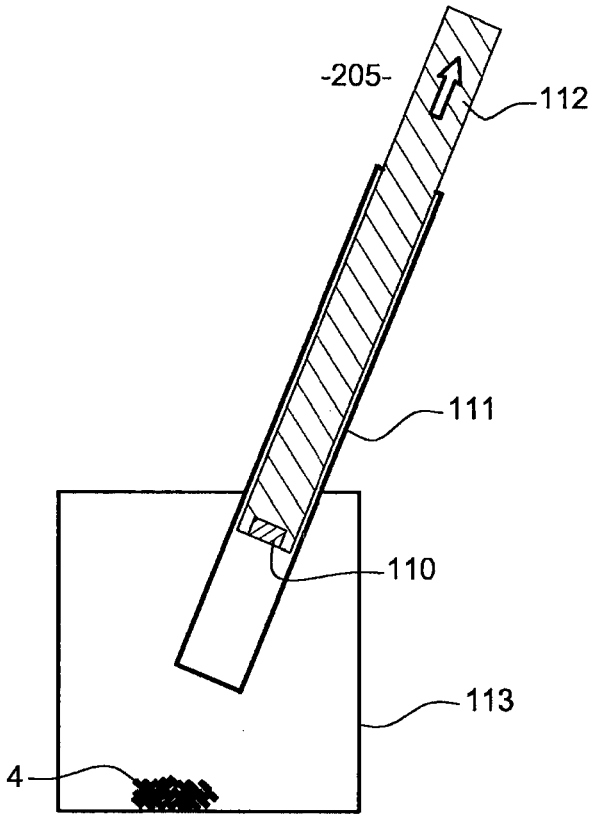
Figure 8:
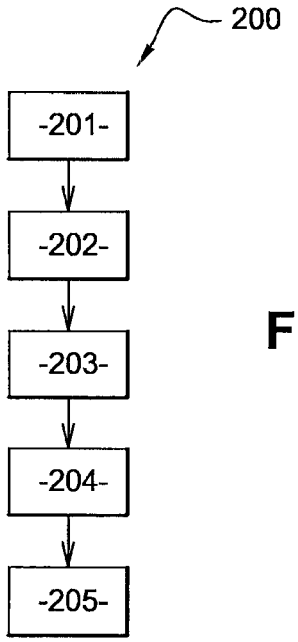
FIG. 8 represents the sequence of steps illustrated in FIGS. 3 to 7.

According to step 205 illustrated in FIG. 7, the particles 4 are then recovered in a plastic pouch 113 by sliding the cylinder 112 in tube 111 upward (in the direction of the arrow); The act of raising the cylinder 112 suppresses the magnetic field exerted by magnet 110 on the particles 4. The pouch 113 may then be sent by the operator to a laboratory for analyzing the particles 4.

Of course, the invention is not limited to the embodiment that has just been described.

In particular, the step of recovering particles at the bottom of the enclosure of the device according to the invention was described in the context of the use of a cylinder sliding in a tube. It is also perfectly possible to recover particles by turning the device according to the invention upside down in order to directly transfer the particles (that are no longer trapped by the previously removed magnet 106) into a pouch.

Furthermore, the device was described more specifically with a removable magnet 106. A non-removable electromagnet may also be used, whose magnetization will be controlled depending on whether one wishes or does not wish to maintain the trapped particles.

In addition, even if the device preferentially comprises a plurality of nozzles distributed around the enclosure, one may also consider the use of only a single injection nozzle by rotating the plug inside the device according to the invention so that the jet of compressed air reaches the entire surface of the bar on which the particles are trapped.

The device according to the invention that has just been described finds a particularly interesting application in a use with magnetic plugs utilized on all machines for which the ability to detect wear is important, particularly on aeronautical turbine engines. On these machines, the utilization of several magnetic plugs on various oil systems may enable a part presenting the start of wear to be rapidly located.

The invention claimed is:

1. A recovery device for recovering magnetic particles trapped on a magnetic plug, said magnetic plug comprising a supporting end and a magnetized element configured to retain the magnetic particles driven by a liquid resulting from the wear of parts with which said liquid has been in contact, said recovery device comprising:

a magnetization device, and an enclosure including:

an opening, said enclosure configured to removably receive said magnetic plug via said opening such that said magnetized element is housed inside said enclosure and said supporting end is situated outside said enclosure, said opening being sized so that said supporting end blocks said opening;

an injection nozzle configured to inject a gaseous fluid inside said enclosure, said nozzle being oriented such that, in use, a flow of the gaseous fluid expels the magnetic particles retained on said magnetized element toward a bottom of said enclosure, said magnetization device being arranged to trap, by magnetization, said particles urged toward the bottom of said enclosure, wherein the enclosure includes a lateral wall that extends longitudinally from the bottom of the enclosure toward the opening of the enclosure, and wherein the injection nozzle is formed in the lateral wall.

2. The device according to claim 1, comprising a plurality of injection nozzles assembled on said enclosure.

3. The device according to claim 2, wherein said magnetized element of said magnetic plug is a magnetic bar, and wherein said enclosure is sized to receive said magnetic bar inside said enclosure and said nozzles are disposed laterally on said enclosure so as to be arranged on both sides of said bar when the bar is in position inside said enclosure.

4. The device according to claim 3, wherein each of said nozzles is tilted 45° with relation to a longitudinal axis of the bar when the bar is in position inside said enclosure.

5. The device according to claim 1, wherein said magnetization device is disposed outside said enclosure near the bottom of said enclosure.

6. The device according to claim 1, wherein said magnetization device is removably assembled on an outer face of the bottom of said enclosure.

7. The device according to claim 1, wherein said magnetization device is arranged so as to be situated at a distance of between 2 and 5 cm from said magnetized element when the magnetized element is inside said enclosure.

8. The device according to claim 1, comprising a seal capable of ensuring the sealing between said supporting end and said opening when said supporting end blocks said opening.

9. The device according to claim 8, wherein the seal is an O-ring.

10. The device according to claim 1, wherein the magnetization device includes a magnet.

11. The device according to claim 10, wherein the magnet has a cylindrical shape.

12. The device according to claim 2, wherein the plurality of injection nozzles are formed in the lateral wall and configured to inject the gaseous fluid inside the enclosure.

13. The device according to claim 1, wherein the bottom of the enclosure is formed by a wall partition that has an inner side for retaining the magnetic particles and an outer side for receiving the magnetization device.

14. A method for recovering magnetic particles trapped on a magnetic plug, said method comprising:

placing the magnetic plug in a recovery device, said magnetic plug comprising a supporting end and a magnetized element configured to retain the magnetic particles driven by a liquid resulting from the wear of parts with which said liquid has been in contact, and said recovery device comprising a magnetization device, and an enclosure including:

an opening, said enclosure configured to removably receive said magnetic plug via said opening such that said magnetized element is housed inside said enclosure and said supporting end is situated outside said enclosure, said opening being sized so that said supporting end blocks said opening, and an injection nozzle configured to inject a gaseous fluid inside said enclosure, said nozzle being oriented such that, in use, a flow of the gaseous fluid expels the magnetic particles retained on said magnetized element toward a bottom of said enclosure, said magnetization device being arranged to trap, by magnetization, said particles urged toward the bottom of said enclosure, wherein the enclosure includes a lateral wall that extends longitudinally from the bottom of the enclosure toward the opening of the enclosure, and wherein the injection nozzle is formed in the lateral wall, the magnetic plug being placed in the recovery device via the enclosure opening such that the magnetized element of the plug retaining the magnetic particles is housed inside the enclosure and the supporting end of the plug is situated outside the enclosure so as to block the enclosure opening;

injecting the gaseous fluid via the injection nozzle so that the particles retained on the magnetic element are evacuated toward the bottom of the enclosure;

trapping the evacuated particles toward the bottom of the enclosure by said magnetization device, and recovering the particles trapped by said magnetization device.

15. The method according to claim 14, wherein recovering the particles comprises:

removing the magnetic plug and magnetization device removably assembled under the bottom of the enclosure;

recovering the particles by using a magnetized bar assembled slidingly in a tube.

16. The method according to claim 14, wherein the gaseous fluid is compressed air that is filtered.

17. The method according to claim 14, wherein the magnetization device includes a magnet.

18. The method according to claim 17, wherein the magnet has a cylindrical shape.

* * * * *